US006474247B1

(12) United States Patent
Thomas

(10) Patent No.: US 6,474,247 B1
(45) Date of Patent: Nov. 5, 2002

(54) ACCESS CONTROL SYSTEM

(76) Inventor: Malcolm William Thomas, Extension 12, 12 Cliffside Crescent, Northcliff, Johannesburg 2115 (ZA)

( * ) Notice: Subject to any disclaimer, the term of this patent is extended or adjusted under 35 U.S.C. 154(b) by 0 days.

(21) Appl. No.: 09/674,080

(22) PCT Filed: Apr. 29, 1999

(86) PCT No.: PCT/IB99/00786

§ 371 (c)(1),
(2), (4) Date: Dec. 21, 2000

(87) PCT Pub. No.: WO99/55995

PCT Pub. Date: Nov. 4, 1999

(30) Foreign Application Priority Data

Apr. 29, 1998 (ZA) ..... 98/3611

(51) Int. Cl.[7] ..... E04H 9/00

(52) U.S. Cl. ..... 109/2; 109/24.1; 109/64; 109/73; 109/74

(58) Field of Search ..... 109/2, 24.1

(56) References Cited

U.S. PATENT DOCUMENTS 5,291,148 A * 11/1894 Whitman ..... 62/254
557,389 A * 3/1896 Holmes ..... 109/77
954,547 A * 4/1910 Spivey ..... 109/73
2,345,478 A * 3/1944 Hundley ..... 109/2
3,498,011 A * 3/1970 Lindgren ..... 52/31
4,399,755 A * 8/1983 Wiedmann ..... 109/2
4,911,087 A * 3/1990 Couvrette ..... 109/24.1
5,542,211 A * 8/1996 Colombo ..... 49/42

* cited by examiner

*Primary Examiner*—Robert J. Sandy
*Assistant Examiner*—Carlos Lugo
(74) *Attorney, Agent, or Firm*—Ladas & Parry

(57) ABSTRACT

This invention relates to an access control system. More particularly, the invention relates to an access control system and to a a component for an access control system. An access control system includes a cubicle defining means mountable adjacent an access opening to a premises, the cubicle defining means defining a cubicle (24) and an opening (26) which is arranged transversely to the access opening (28) of the premises and a closure member (16) pivotally arranged relative to the access opening (28) to be pivotal through a predetermined arc, an included angle of the arc being an acute angle, the closure member (16) being pivotal. between a first position at one end of the arc, in which the access opening (28) is closed off and a third position at the other end of the arc, past a second, intermediate position. The system also includes a releasable obstruction arrangement which is operatively mounted relative to the closure member (16) to releasably obstruct movement of the closure member from the second position to the first position.

14 Claims, 7 Drawing Sheets

ACCESS CONTROL SYSTEM

A cubicle defining portion mountable adjacent an access opening in a wall of a premise, the cubicle defining portion defining a cubicle having an opening which is arranged transversely and adjacent to the access opening;

an extension member, extending from a side panel of the cubicle defining portion;

a closure member pivotally arranged relative to the access opening to be pivotal through a predetermined arc, an included angle of the arc being an acute angle, the closure member being pivotal between a first position at one end of the arc in which the access opening is closed off, and a third position at the other end of the arc, in which the closure member lies substantially in the same plane as the extension member, past a second, intermediate position, characterised therein that the system comprises a locking mechanism which is operatively mounted relative to the closure member for locking it in the second position for inhibiting access to the premises; and a releasable obstruction member which is associated with the locking mechanism to releasably obstruct movement of the closure member from the second position to the first and third positions.

The cubicle defining portion, the closure member and the extension member may be configured so that, once a person is positioned within the cubicle, the closure member must be pivoted into a position at least proximate the said one or said further position to permit the person to exit the cubicle.

The system may further include a booth having a portion which forms the cubicle defining portion and comprising a framework which pivotally supports the closure member. The closure member may be in the form of a door.

The locking mechanism may also be configured to lock the door in the first position and the third position.

The system may include a detecting means for detecting the presence of the person within the cubicle. The system may also include an entering means for enabling the person to enter information to gain access to the premises. The entering means may be in the form of a key pad, a card reader, or the like.

Thus, the locking mechanism may include a control means which is responsive to the detecting means and the entering means for disabling the locking mechanism and allowing the door to be moved from its second position to its first or third position.

The locking mechanism may include a manual override arrangement. The arrangement may be configured to permit a user to manually operate the locking mechanism in the event of a power failure.

The extension member of the cubicle defining means may be in the form of a flap which extends from one wall of the cubicle defining means at an angle to said wall to lie in the plane of the door when the door is in its third position. Conveniently, to enable bulky objects to be conveyed into the premises through the system, the flap may be hingedly connected to said wall of the cubicle defining means to be pivoted out of the way. Further, if desired, the flap may be connected to the door via a linkage so that the flap moves to the position in said plane as the door is moved from its first position to its third position.

The cubicle defining means may comprise, for new installations, three wall portions with the walls being arranged at right angles to each other to define the cubicle. Conversely, for existing premises, the cubicle defining means may only have two walls which are arranged at substantially right angles to each other with a third wall of the cubicle then being defined by an existing wall of the premises.

The system may include a drive means for driving the door between its first, second and third positions.

Figure 1:
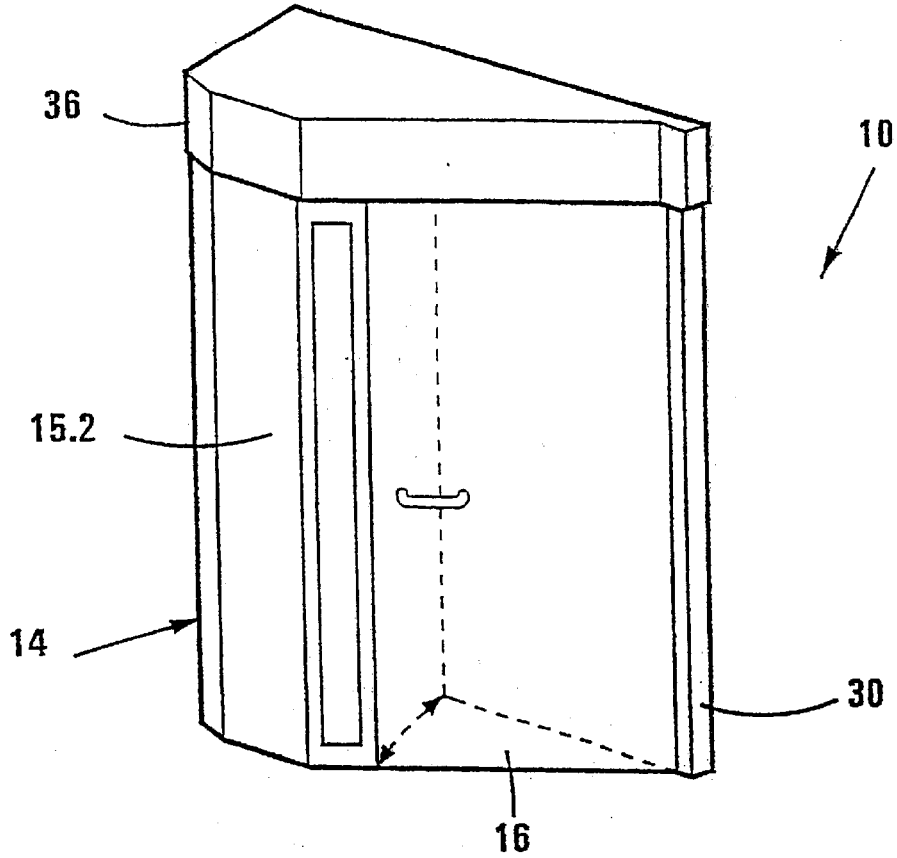
FIG. 1 shows a three dimensional view of a first embodiment of an access control system, in accordance with the invention.

Referring to the drawings, reference numeral 10 generally designates a first embodiment of an access control system in the form of a security booth. The booth 10 comprises a framework 12 (FIG. 2) on which a cubicle defining portion 14, which defines a cubicle 24, is supported. A closure member in the form of a door 16 is pivotally supported on the framework 12. A door handle 149 is provided on the door 16.

The portion 14 includes a pair of opposed, side panels 15.1, 15.2 and an end panel 17. One of the side panels 15.1 is mounted on a wall 19 of a building.

An extension member in the form of a flap 18 extends from an opposed side panel 15.2 of the cubicle defining portion 14. The flap 18 is hingedly connected via a hinge 22 to the side panel 15.2 of the cubicle defining portion 14.

Figure 2:
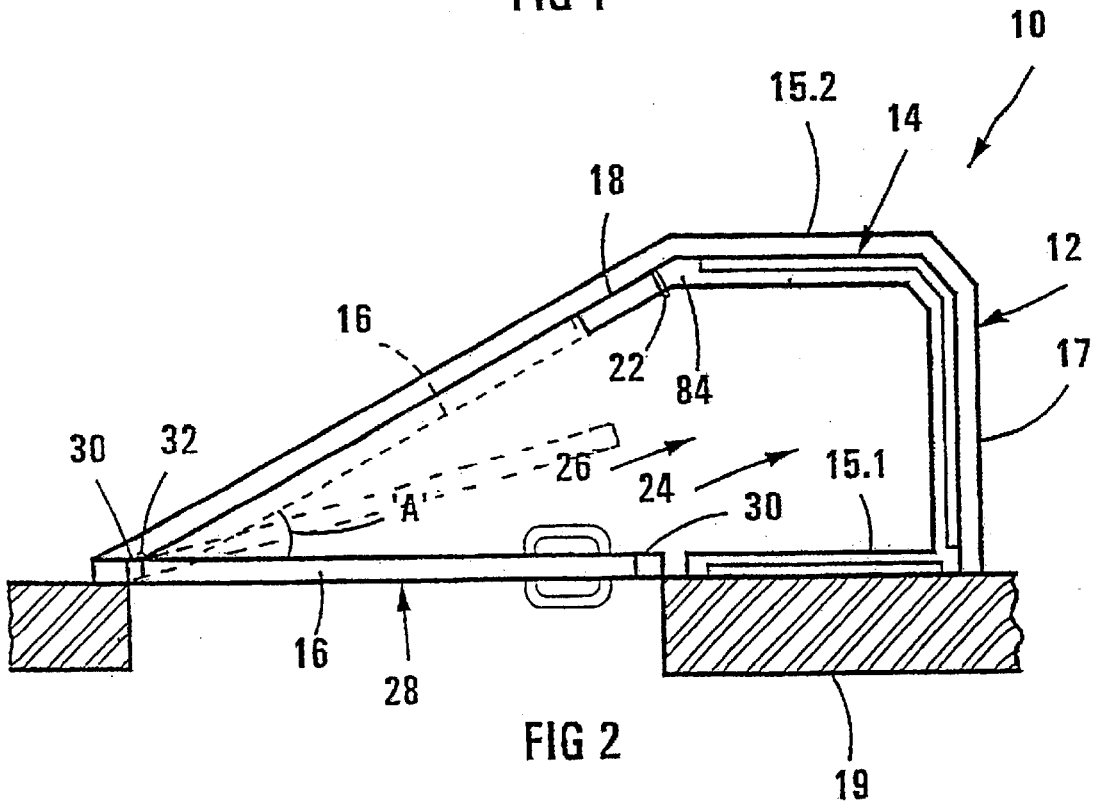
FIG. 2 shows a schematic, sectional plan view of the system of FIG. 1.
Figure 3:
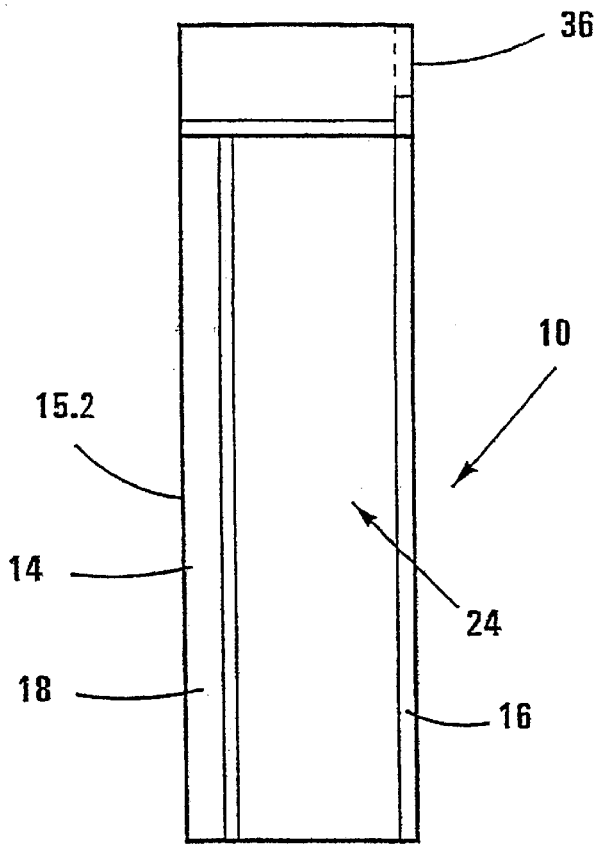
FIG. 3 shows an end view of the system of FIG. 1.

The door 16 is pivotal between a first position, as shown in solid lines in FIG. 2 of the drawings, and a third position, as shown in dotted lines in FIG. 2 of the drawings in which the door 16 is in the same plane as the flap 18, past a second, intermediary position, also shown in dotted lines, through a predetermined arc of angle 'A'. The angle 'A' is an acute angle and, preferably, is less than 45° and, optimally, is about 30°.

The cubicle defining portion 14 defines a cubicle 24 therein and the panels 15.1, 15.2, 17 of the cubicle defining portion 14 define an opening 26 which extends at substantially right angles to an access opening 28 closed off by the door 16 when the door 16 is in its first position. The access opening 28 is bounded by a door frame 30 on which the door 16 is hingedly mounted via a hinge 32.

The booth 10 includes a locking mechanism 34 (FIG. 4) which is mounted in an enclosure 36 (FIG. 1) above the booth 10, in use. The locking mechanism 34 includes a locking plate 38 and a pair of displacing members 40, 42 which act on the plate 38, as will be described in greater detail below. An upper edge of the door 16 carries a releasable obstruction member in the form of a pin 44 thereon and the plate 38 has a number of catches 46 defined thereon which are engaged by the pin 44 when an attempt is made to move the door from its third position (as shown in solid lines in FIG. 4 of the drawings) or the second position to its first position.

The plate 38 is pivotally mounted in the enclosure 36 via a pivot pin 48 which extends through a slot 50 in the plate 38. When the door 16 is moved from its third position to its second position, the pin 44 can pass the catches 46 due to the pivotal mounting of the plate 38 about the pivot pin 48. In this regard it is to be noted that the displacing member 40 includes a piston/cylinder assembly 52 with a link 54 carried on a piston of the assembly 52. The link 54 has an elongate slot 56 defined therein to connect the link 54 to the plate 38 in a lost-motion manner. For this purpose, a pin 58 projects from the plate 38 and is received in the slot 56 of the link 54.

In a similar manner, the displacing member 42 comprises a piston/cylinder assembly 60 with a link 62 connected to a piston of the assembly 60. The link 62 defines a slot 64 therein in which a pin 66, projecting from the plate 38, is received in a lost-motion manner.

Figure 4:
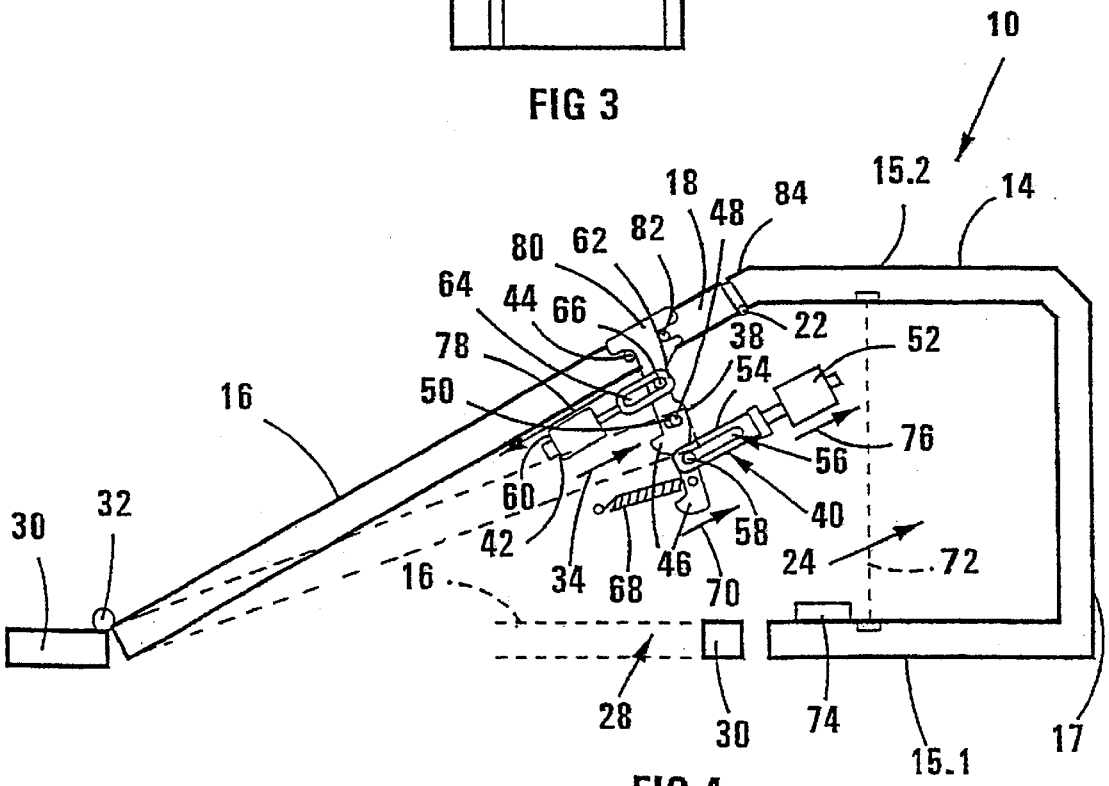
FIG. 4 shows a schematic representation of a locking mechanism of the system of FIG. 1.
Figure 5:
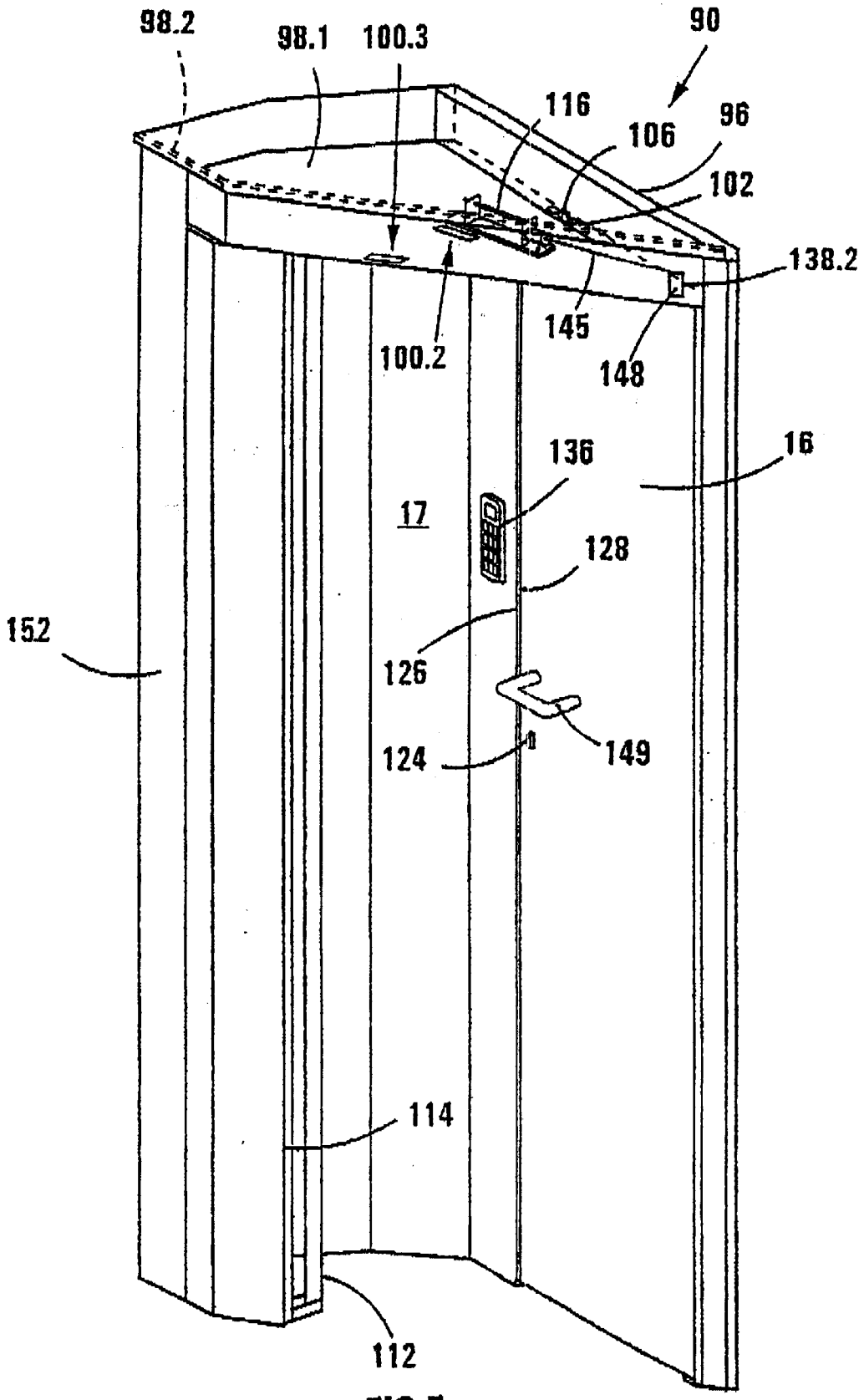
FIG. 5 shows a schematic, three dimensional view of a second embodiment of an access control system, in accordance with the invention.

The locking mechanism 34 also includes an urging means in the form of a coil spring 68 which urges the plate 38 to the position as shown in FIG. 4 of the drawings.

As described above, when the door 16 is moved from its third position to its second position, the pin 44 slides past the catches 46 due to the displacement of the plate 38 in the direction of arrow 70. Once the pin 44 has passed the catches 46, the spring 68 returns the plate 38 to its rest position. The catches 46 are so shaped that should an unauthorised attempt be made to move the door 16 from its second position to its first position, the pin 44 bears against one of the catches 46 and so inhibits return of the door 16 to its third position.

To enable the door 16 to be returned from the second position to the first position, the booth 10 includes a detecting means in the form of an infra-red detector 72 therein. Further, the booth 10 includes an entering means in the form of a keypad 74.

Hence, in use, should a person wish to gain access to the premises in which the booth 10 is mounted, the door 16 is moved from its first position, past its second position, towards its third position to enable the person to enter the cubicle 24 of the cubicle defining portion 14. Should the person not move the door 16 to its third position, where it could lock, enter the cubicle and move the door to its first position without entering the code, the door 16 will be locked in the second position. The detector 72 detects the presence of the person in the cubicle 24 and the person enters an access code via the keypad 74. Should the correct access code be entered, the link 54 of the piston/cylinder assembly 52 is retracted, in the direction of arrow 76, so moving the catches 46 out of the path of the pin 44. Thus, the door 16 can be moved from its third position, past its second position to its first position to enable the person to pass the flap 18 into the interior of the premises. Should no person be detected by the detector 72 or the incorrect access code be entered via the keypad 74 the link 54 of the displacement member will not be retracted thereby inhibiting movement of the door 16 from its second position to its first position.

To enable bulky objects to be moved through the booth 10 into or out of the premises, the displacing member 42 is operated to cause the link 62 to be retracted in the direction of arrow 78. In so doing, a catch 80 defined by the plate 38 releases a pin 82 projecting from a top of the flap 18. The flap 18 can then be pivoted about the hinge 22 to lie against the panel 15.2 of the cubicle defining portion 14.

It is to be noted that, to ensure that the flap 18 lies in the same plane as the door occupies when the door 16 is in its third position, the flap 18 abuts against an angled extension 84 of the panel 15.2 of the cubicle defining portion 14.

In FIGS. 5 to 9, reference numeral 90 generally indicates a second embodiment of an access control system in the form of a security booth. With reference to FIGS. 1 to 4, like numerals refer to like parts, unless otherwise specified.

In the second embodiment of the invention, a different locking mechanism is illustrated. In this case, the control booth 90 includes a power supply 92 and a PLC (programmed logic controller) and user interface 94.

The booth 90 has a roof 96 which is mounted on the panels 15.1, 15.2. The roof 96 comprises a pair of spaced panels 98, namely a lower panel 98.1 and an upper panel 98.2.

The lower panel 98.1 has three spaced slots 100.1, 100.2, 100.3 defined therein. A locking device 102 is mounted in an upper edge 104 of the door 16. The locking device 102 is in the form of a mortise-type lock which has a locking member 106 which is dimensioned to be received in any one of the slots 100.1, 100.2, 100.3. The locking device 102 is connected to the PLC 94 to be controlled thereby.

A sensing device 108.1, 108.2, 108.3 is mounted proximate each slot 100.1, 100.2, 100.3 to detect the presence of the locking device 102 when the locking member 106 is aligned with any one of the slots 100.1, 100.2, 100.3. The sensing devices 108.1, 108.2, 108.3 are also connected to the PLC so that, when the locking member 106 is detected to be in alignment with any one of the slots 100.1, 100.2, 100.3, the PLC actuates the locking device 102 to extend the locking member 106 into any of the slots 100.1, 100.2, 100.3.

Figure 6:
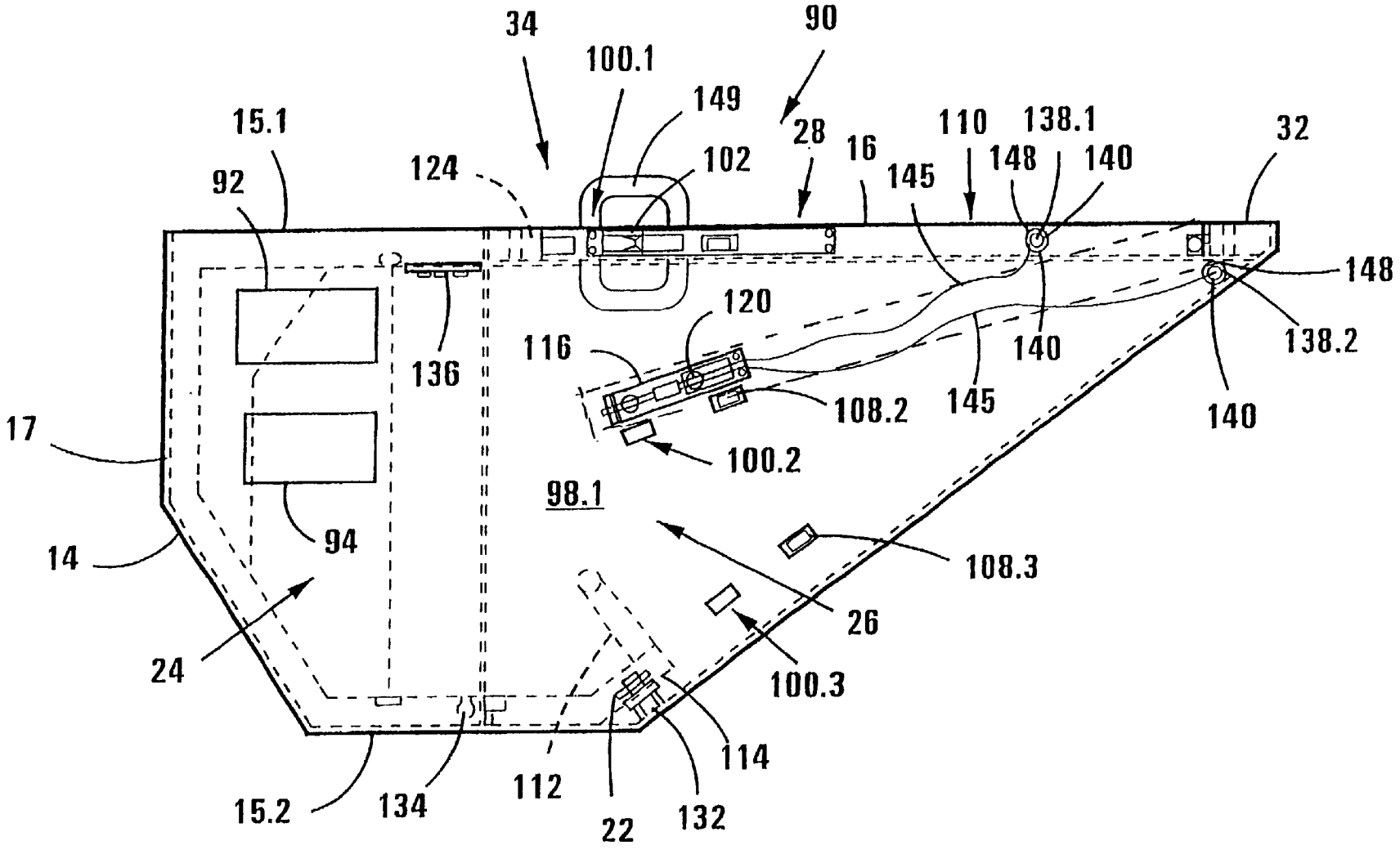
FIG. 6 shows a schematic plan view of the system of FIG. 5.
Figure 7:
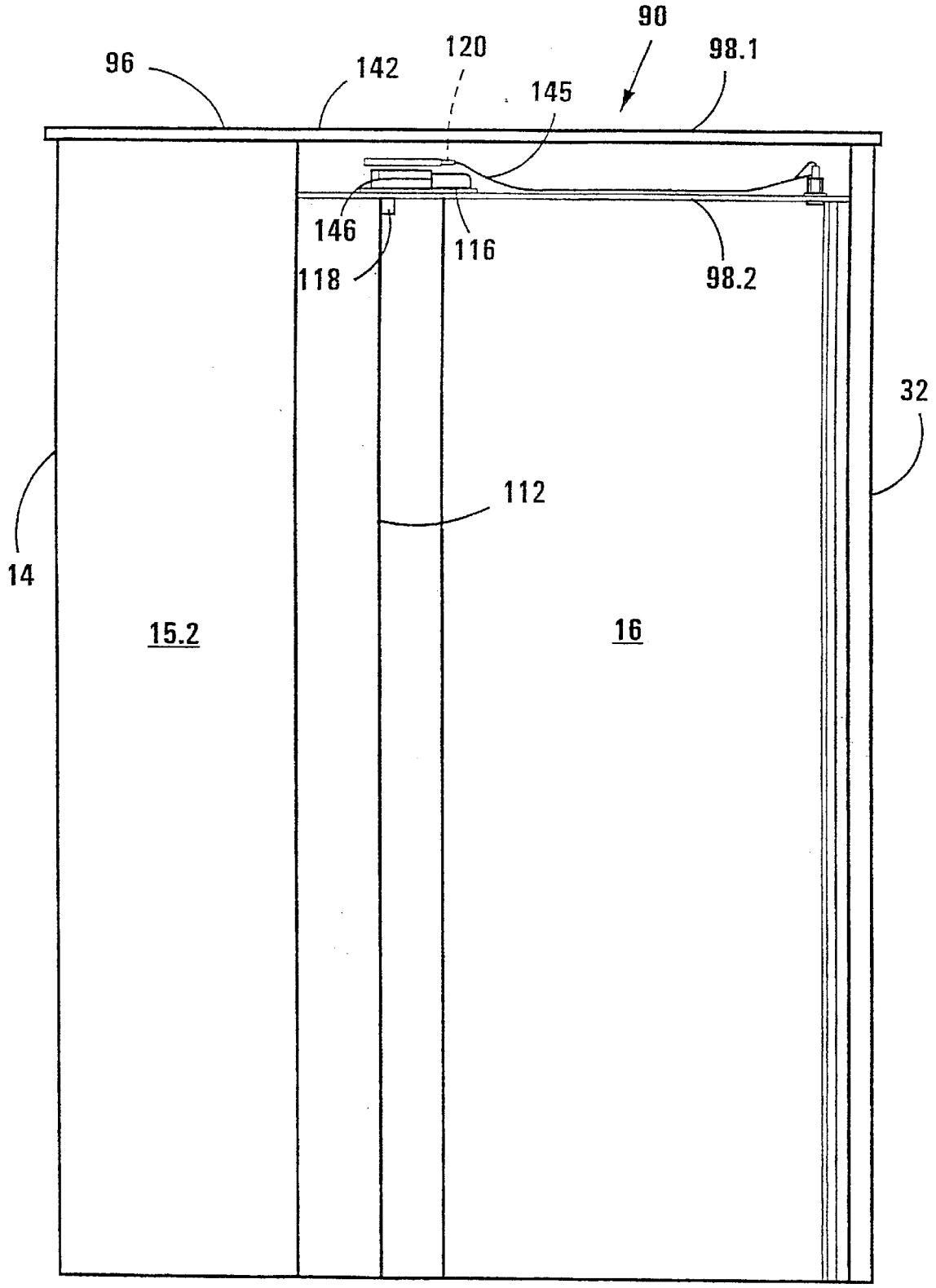
FIG. 7 shows an inside view of the system of FIG. 5.
Figure 8:
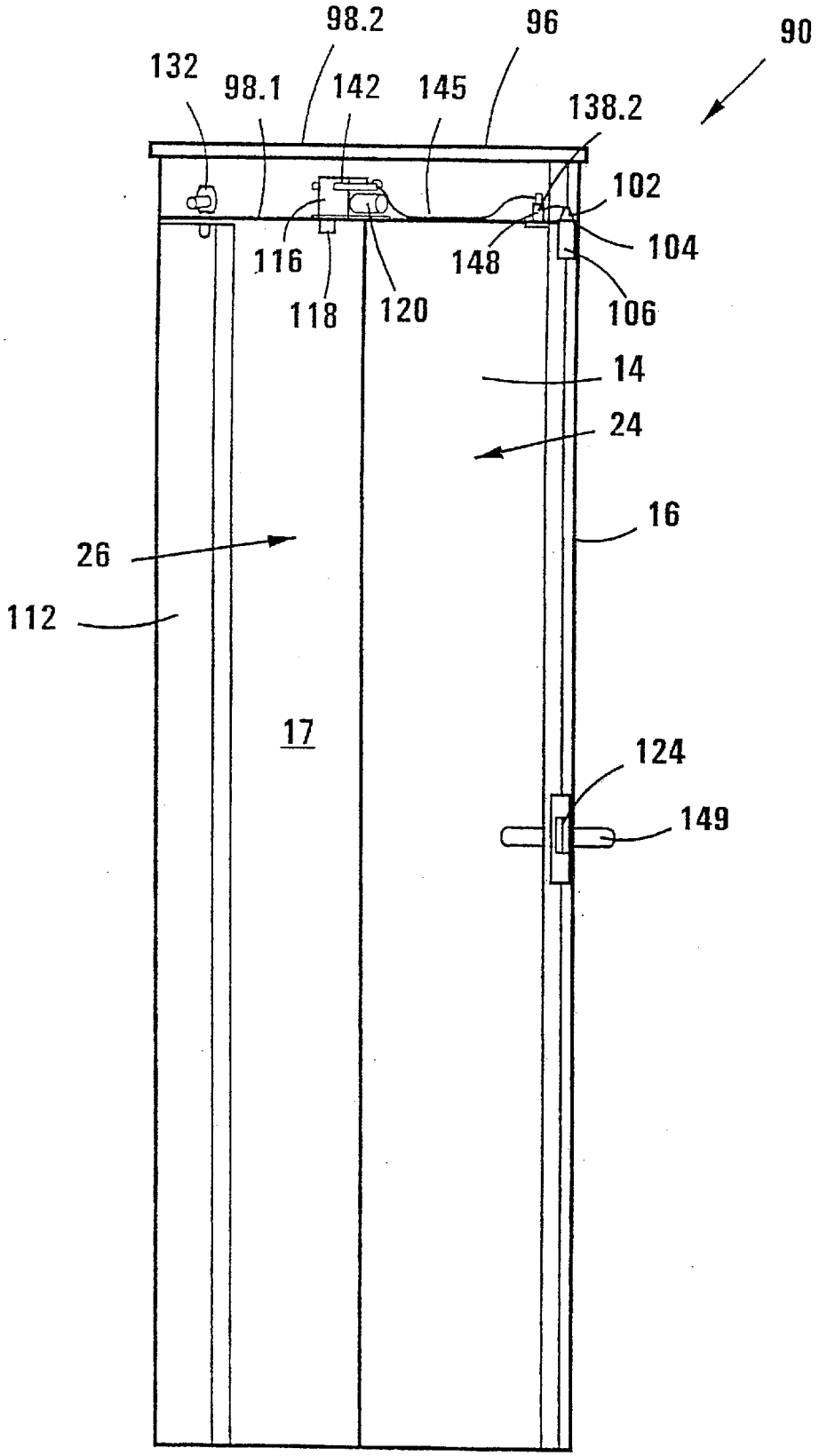
FIG. 8 shows a side view of the system of FIG. 5.
Figure 9:
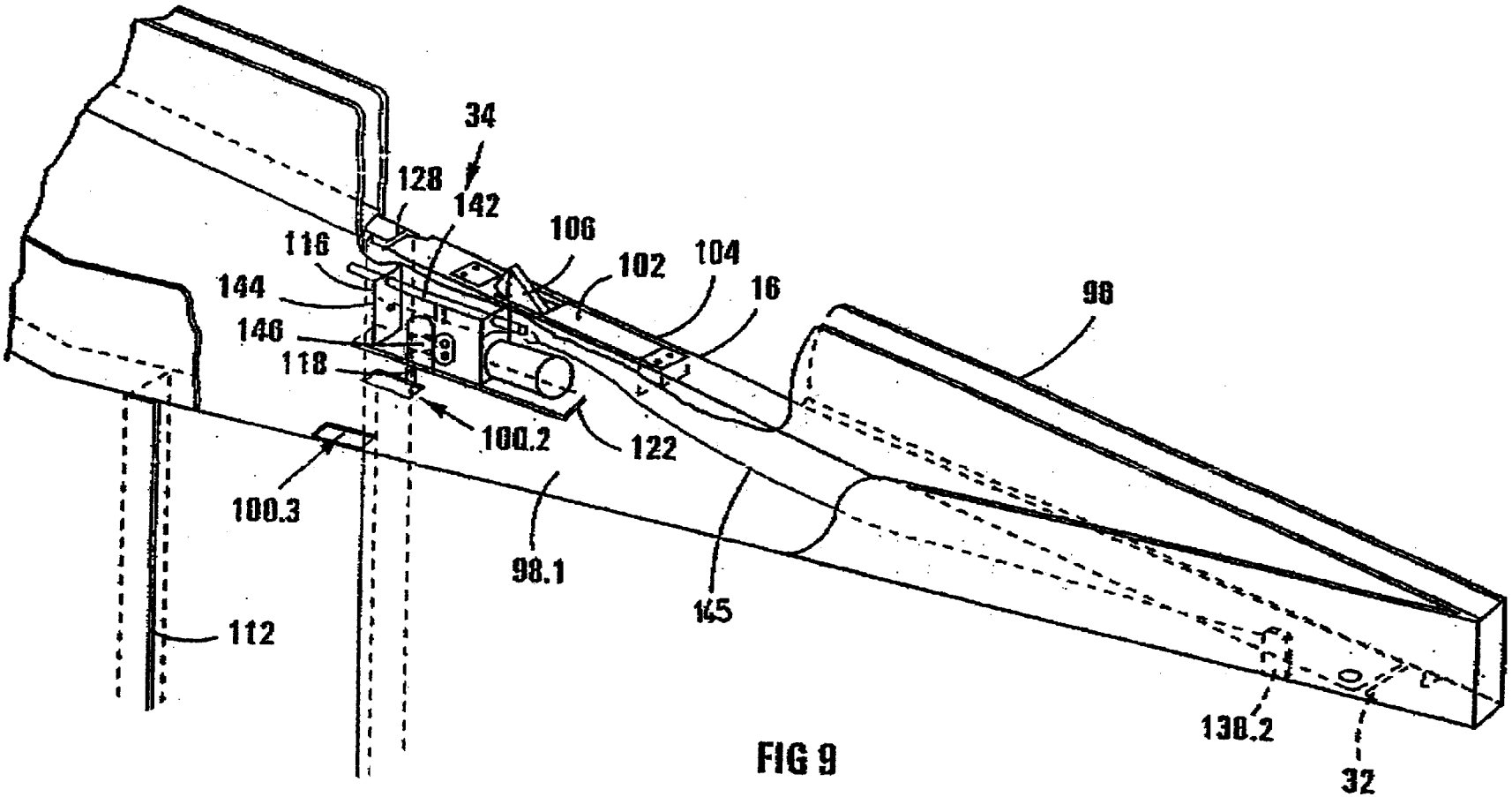
FIG. 9 shows a cut-away view of part of a locking mechanism of the system of FIG. 5.

The slots 100.1, 100.2, 100.3 are positioned so that, when the door 16 is in a first, closed position, as shown in FIG. 6, the locking member 106 is received in a first slot 100.1. When the door 16 is in a second, intermediate position, as shown in dotted lines, the locking member 106 is received in a second slot 100.2. When the door 16 is in a third, closed position, the locking member 106 is received in a third slot 100.3.

The booth 90 is positioned so that, when the booth 90 is mounted on the wall 19 of the building, the door 16 closes an access opening 110 of the building, when the door 16 is in its first position.

The slots 100.1, 100.2, 100.3 are positioned so that, in order for a person to proceed from the access opening 110 to the cubicle 24, the door 16 must move at least past its second position. The side panel 15.2 has a control flap 112 hingedly mounted on a free end 114 thereof. The control flap 112 is pivotal from a first position and a second position, shown in FIGS. 5 and 6, in which a gap between the control flap 112 and the second slot 100.2 is enlarged. The control flap 112 is dimensioned so that when a person is in the cubicle 24, the door 16 is in its second position, and the flap 112 is in its first position, a user is prevented from exiting the cubicle 24.

A solenoid door blocker 116 is mounted on the lower roof panel 98.1. The solenoid roof blocker 116 is shown in more detail in FIG. 9. The door blocker 116 includes an obstruction member 118 which is driven by a solenoid 120. The solenoid 120 is such that, in its fail-secure position, the obstruction member 118 extends downwardly through an opening 122 to project downwardly from the lower panel 98.1. The blocker 116 is positioned adjacent the slot 100.2 intermediate the slots 100.1 and 100.3.

The blocker 116 incorporates a sensor (not shown) which is capable of sensing the door 16 when the door 16 passes the slot 100.2. The sensor then serves to actuate the solenoid 120 so that the solenoid 120 releases the obstruction member 118 so that the obstruction member 118 inhibits the door 16 from returning to its first position once the door 16 has passed the slot 100.2.

A further locking device 124 which is also in the form of a mortise-type lock is mounted in a free side edge 126 of the door 16. A free side edge 128 of the panel 15.1 has a slotted recess which is dimensioned to receive a locking member of the locking device 124. The locking device 124 is key-operated so that a user can unlock or lock the device 124 via a key from inside the building.

It is to be understood that the further locking device 124 can also be connected to the. PLC 94 to be controlled thereby. In this case, instead of being key operated, the device 124 can be operated electronically, via a card or the like.

The device 124 is connected to the PLC 94 so that, when a user unlocks the device 124, the locking member 106 moves out of the slot 100.1.

In its operative position, the control flap 112 is locked in a position in which the flap 112 extends from the free end 114 of the panel 15.2 to constrain the movement of the door 16 between its first and third positions. A control flap lock 132 is mounted on the control flap 112 to permit the control flap 112 to be unlocked and pivoted into the cubicle 24. This permits the door 16 to pivot through 90°, if direct access to the building is required, This could be necessary for the movement of bulky equipment through the booth 90.

A presence sensor 134 is mounted in the cubicle 24 to detect the presence of a person within the cubicle 24. The presence sensor 134 is also connected to the PLC 94. A key pad 136 is mounted on the panel 15.1 to be accessible to a person in the cubicle 24. The key pad 136 is connected to the PLC 94 so that when a correct code is entered on the key pad 136, the PLC actuates the solenoid 120 to permit the door 16 to move into its first position.

In order to enter the building, when the door 16 is in its first position, the door 16 is first unlocked. The door 16 is then pushed past the door blocker 116 (at the second position) which actuates to prevent the door 16 from being moved back into its first position. At this stage, there is sufficient space for the user to enter the cubicle 24 but not to exit the cubicle 24 into the building.

The person then enters a code on the key pad 136. In the event that the code is recognised by the PLC 94, the obstruction member 118 (at the second position) is withdrawn to permit the door 16 to be moved back into its first position so that a person can exit the cubicle and enter the building. The PLC 94 is such that in the event that a presence of a person and the correct code entered on the key pad 136 are not simultaneous occurrences, the door obstruction member 118 will not be withdrawn, thereby inhibiting movement of the door 16 past the second position. It will be appreciated that this inhibits hostage situations within the cubicle 24.

In the event that the door is moved into the second position, with the locking member 106 aligned with the slot 100.2 the sensing device 108.2 senses the presence of the door 16 and the PLC then actuates the locking device 102 so that the locking member 106 moves into the slot 100.2 thereby locking the door 16 in position. Release of the locking device 102 occurs in the same manner as release of the door blocker 116, as described above. In the event that the door 16 is moved into the third position with the locking member 106 aligned with the slot 100.3, then the sensing device 108.3 signals the PLC 94. The PLC 94 then actuates the locking device 102 and the locking member 106 is driven into the slot 100.3 so that the door 16 is locked in its third position.

Since the obstruction member 118 moves into its blocked position in a fail-secure condition, this will occur should there be a power failure. The door blocker 116 is connected to a pair of barrel/cylinder locks 138.1, 138.2. One lock 138.1 is accessible from outside the building. The other lock 138.2 is accessible from inside the building. A cable 145 is connected to the cylinder 140 of each block 138. Each cable 145 is connected to a rod 142 which is slidably mounted in a housing 144 of the blocker 116. The rod 142 is connected to a 90° camming arrangement 146. The camming arrangement 146 is connected to the obstruction member 118. Each cylinder 140 is configured to receive a high security key (not shown). Upon insertion and rotation of the key, each cylinder 140 can be removed from its associated barrel 148. By pulling the cylinder 140, and thus its associated cable 145, the rod 142 slides relative to the housing 144 and actuates the 90° camming arrangement 146 so that the obstruction member 118 is withdrawn from the opening 122. opening 122.

The locking device 102 is also manually operable via a high security key so that the locking device can be overridden should a power failure occur.

The control flap lock 132 is operable via a T-key which is insertable into a locking mechanism (not shown) above the control flap 112.

It follows that the booth 90 can be opened and closed manually in the event of a power failure.

The booth 90 includes an audible alarm (not shown) which is actuated should the power supply be returned to the control booth while the locking device 102, the control flap 112 and the blocker 116 are in the open condition as a result of being manually operated.

It is an advantage of the invention that an access control booth is provided which is of relatively low complexity and, accordingly, of relatively low cost. Further, the booth 10 occupies less space than conventional access control systems of which the applicant is aware.

It is a further advantage of the invention that there is provided an access control booth 10, 90, which provides a means whereby a hostage situation within the cubicle 24 is inhibited through co-operation of the presence sensor 134, the locking device 102 and the door blocker 116.

I claim:

1. An access control system which includes a cubicle defining portion (14) mountable adjacent an access opening (28) in a wall (19) of a premise, the cubicle defining portion (14) defining a cubicle (24) having an opening which is arranged transversely and adjacent to the access opening (28);

an extension member (18), extending from a side panel (15.2) of the cubicle defining portion (14);

a closure member (16) pivotally arranged relative to the access opening (28) to be pivotal through a predetermined arc ('A'), an included angle of the arc being an acute angle, the closure member (16) being pivotal between a first position at one end of the arc in which the access opening (28) is closed off, and a third position at the other end of the arc, in which the closure member (16) lies substantially in the same plane as the extension member (18), past a second, intermediate position, characterised therein that the system comprises a locking mechanism (34, 102) which is operatively mounted relative to the closure member (16) for locking the closure member (16) in the second position, so that an end of the closure member (16) divides the opening of the cubicle (24) into part openings; and a releasable obstruction member (44, 118) which is associated with the locking mechanism (34, 102) to releasably obstruct movement of the closure member (16) from the second position to the first and third positions.

2. The access control system as claimed in claim 1, characterised therein that the system includes a booth (10) having a portion which forms the cubicle defining portion (14) comprising a framework (12) which pivotally supports the closure member (16).

3. The access control system as claimed in claim 1, characterised therein that the closure member (16) is in the form of a door.

4. The access control system as claimed in claim 1, characterised therein that the locking mechanism (34, 102) is configured to also lock the door in the first position and the third position.

5. The access control system as claimed in claim 4, characterised therein that a detecting means is provided for detecting the presence of a person within the cubicle (24).

6. The access control system as claimed in claim 5, characterised therein that an entering means is provided for enabling a person to enter information to gain access to the premises.

7. The access control system as claimed in claim 6, characterised therein that the locking mechanism (34, 102) includes a control means which is responsive to the detecting means and the entering means for disabling the locking mechanism (34, 102) and allowing the door to be moved from its second position to its first or third position.

8. The access control system as claimed in claim 4, characterised therein that the locking mechanism (34, 102) includes a manual override arrangement, which is configured to permit a user to manually operate the locking mechanism (34, 102) in the event of a power failure.

9. The access control system as claimed in claim 1, characterised therein that the extension member (18) of the cubicle defining portion (14) is in the form of a flap which extends from one wall of the cubicle defining portion (14) at an angle to said wall.

10. The access control system as claimed in claim 9, characterised therein that the flap is hingedly connected to said wall of the cubicle defining portion (14) to be pivoted out of the way to enable bulky objects to be conveyed into the premises.

11. The access control system as claimed in claim 9, characterised therein that the flap is connected to the door via a linkage so that the flap moves to the position in said plane as the door is moved from its first position to its third position.

12. The access control system as claimed in claim 1, characterised therein that the cubicle defining portion (14) comprises, for new installations, three wall portions with the walls being arranged at right angles to each other to define the cubicle (24).

13. The access control system as claimed in claim 1, characterised therein that the cubicle defining portion (14) has, for existing premises, two walls which are arranged at substantially right angles to each other with a third wall of the cubicle (24) then being defined by an existing wall of the premises.

14. The access control system as claimed in claim 1, characterised therein that it includes a drive means for driving the closure member (16) between its first, second and third positions.

* * * * *